US011306268B1

(12) United States Patent
McRoy

(10) Patent No.: US 11,306,268 B1
(45) Date of Patent: Apr. 19, 2022

(54) COMBUSTIBLE STRUCTURE WITH FIRE LOG AND INTEGRATED STARTER FUEL

(71) Applicant: Enviro-Log, Inc., Fitzgerald, GA (US)

(72) Inventor: Ross A. McRoy, Fitzgerald, GA (US)

(73) Assignee: Enviro-Log, Inc., Fitzgerald, GA (US)

( * ) Notice: Subject to any disclaimer, the term of this patent is extended or adjusted under 35 U.S.C. 154(b) by 52 days.

(21) Appl. No.: 16/276,877

(22) Filed: Feb. 15, 2019

(51) Int. Cl.

| | |
|---|---|
| ***C10L 5/36*** | (2006.01) |
| ***C10L 11/04*** | (2006.01) |
| ***C10L 11/06*** | (2006.01) |
| ***F23Q 13/04*** | (2006.01) |
| ***F23B 90/02*** | (2011.01) |

(52) U.S. Cl.
CPC ..... *C10L 5/368* (2013.01); *C10L 11/04* (2013.01); *C10L 11/06* (2013.01); *F23B 90/02* (2013.01); *F23Q 13/04* (2013.01); *C10L 2200/0453* (2013.01)

(58) Field of Classification Search
CPC ..... C10L 2200/0469; C10L 2230/06; C10L 5/365; C10L 5/368; C10L 11/00; C10L 11/04; C10L 11/06; F23Q 13/04
See application file for complete search history.

(56) References Cited

U.S. PATENT DOCUMENTS

| | | | | |
|---|---|---|---|---|
| 4,460,377 | A * | 7/1984 | Kalil | C10L 11/04 44/520 |
| 7,850,746 | B2 * | 12/2010 | Weissman | C10L 5/368 44/541 |
| 2017/0002284 | A1 * | 1/2017 | Price | C10L 11/04 |

FOREIGN PATENT DOCUMENTS

| | | | | |
|---|---|---|---|---|
| WO | WO-2013075196 | A1 * | 5/2013 | C10L 11/04 |

OTHER PUBLICATIONS

Machine Translation of WO 2013/075196 (Year: 2013).*
Machine Translation of Costa (WO-2013075196-A1_(Year: 2013).*

* cited by examiner

*Primary Examiner* — Ellen M McAvoy
*Assistant Examiner* — Ming Cheung Po
(74) *Attorney, Agent, or Firm* — Kilpatrick Townsend & Stockton LLP

(57) ABSTRACT

Described are combustible structures. For example, a combustible structure includes a starter fuel chamber with a starter fuel, an external lighter opening, and an external air opening. The combustible structure includes a conveying fuel chamber adjacent to the starter fuel chamber and including a conveying fuel. The combustible structure includes a partition between the conveying fuel chamber and the starter fuel chamber, the partition including an opening such that combustion in the starter fuel chamber can spread to the conveying fuel chamber through the opening. The combustible structure includes a fuel chamber that includes an artificial fire log and an external vent. The combustible structure includes a retaining structure that provides for ease of transport and holds the artificial fire log in place such that combustion in the conveying fuel chamber spreads to the fuel chamber.

19 Claims, 4 Drawing Sheets

COMBUSTIBLE STRUCTURE WITH FIRE LOG AND INTEGRATED STARTER FUEL

FIELD OF THE INVENTION

This invention relates generally to combustible materials. More specifically, but without limitation, this disclosure involves a combustible structure that includes one or more synthetic or artificial fire logs (or similar for placement in a fireplace, a campfire, or an outdoor firepit.

BACKGROUND

Gathering and assembling firewood for a bonfire, camp fire, grill, or fireplace is tedious and in some public places is prohibited. Additionally, firewood is not always available, for example, when an insect infestation creates a quarantine condition. Various solutions exist to simplify this process. For example, fire starter blocks alleviate the need for wood kindling. Manufactured fire logs, which can be used as a substitute for firewood, are readily available at stores.

But these solutions still require a multi-step process that includes gathering multiple items such as fuel and starter, then arranging the fuel and starter in such a manner as to permit the starter to ignite the fuel. Additionally, manufactured fire logs may not burn for a sufficiently long time or may not create a sufficiently large source of heat. Some manufactured firelogs cannot be used to cook safely in the outdoors.

Hence, a need exists for a firewood substitute that alleviates this multi-step process by providing a convenient and portable solution.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a combustible structure includes a starter fuel chamber with a starter fuel, an external lighter opening, an external air opening, and external exhaust vent. The combustible structure further includes a conveying fuel chamber adjacent to the starter fuel chamber and including a conveying fuel. The combustible structure further includes a fuel chamber adjacent to the conveying fuel chamber, the fuel chamber including an artificial fire log and an external vent. The combustible structure further includes a retaining structure that holds the artificial fire log in place such that combustion in the conveying fuel chamber spreads to the fuel chamber. The combustible structure further includes a cover configurable to hold the starter fuel in the starter fuel chamber and the conveying fuel in the conveying fuel chamber.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to a combustible structure that includes one or more fuels, a lighter opening, air opening, and a vent opening. Examples of fuels include firestarter or firelogs, or parts or components thereof. Examples of composition of the fuels include synthetic, or natural variants, for example, paper, wax, cardboard, sawdust, or a combination thereof. Embodiments of the present invention are self-kindling, i.e., do not need separate kindling to be provided.

In an exemplary use case, the combustible structure is placed in a firepit. The lighter opening and the vent are pushed open by a user. The combustible structure receives ignition via a match or a lighter placed in the lighter opening, which ignites a starter fuel. The starter fuel, held in place by a starter fuel partition, starts to combust, draws air from the vent and the lighter opening, and ignites a conveying fuel. The starter fuel continues to combust feeding the conveying fuel more energy while slowing consuming the starter partition. The conveying fuel, held in place via a retaining structure, conveys or propagates the combustion process such that one or more fire logs stored internally to the structure are ignited. Over time, the combustible structure continues to burn itself. In this manner, the combustible structure acts as a firewood substitute that is convenient, portable, and alleviates the need to gather different sizes of firewood and arrange the firewood with a starter fuel.

Figure 1:
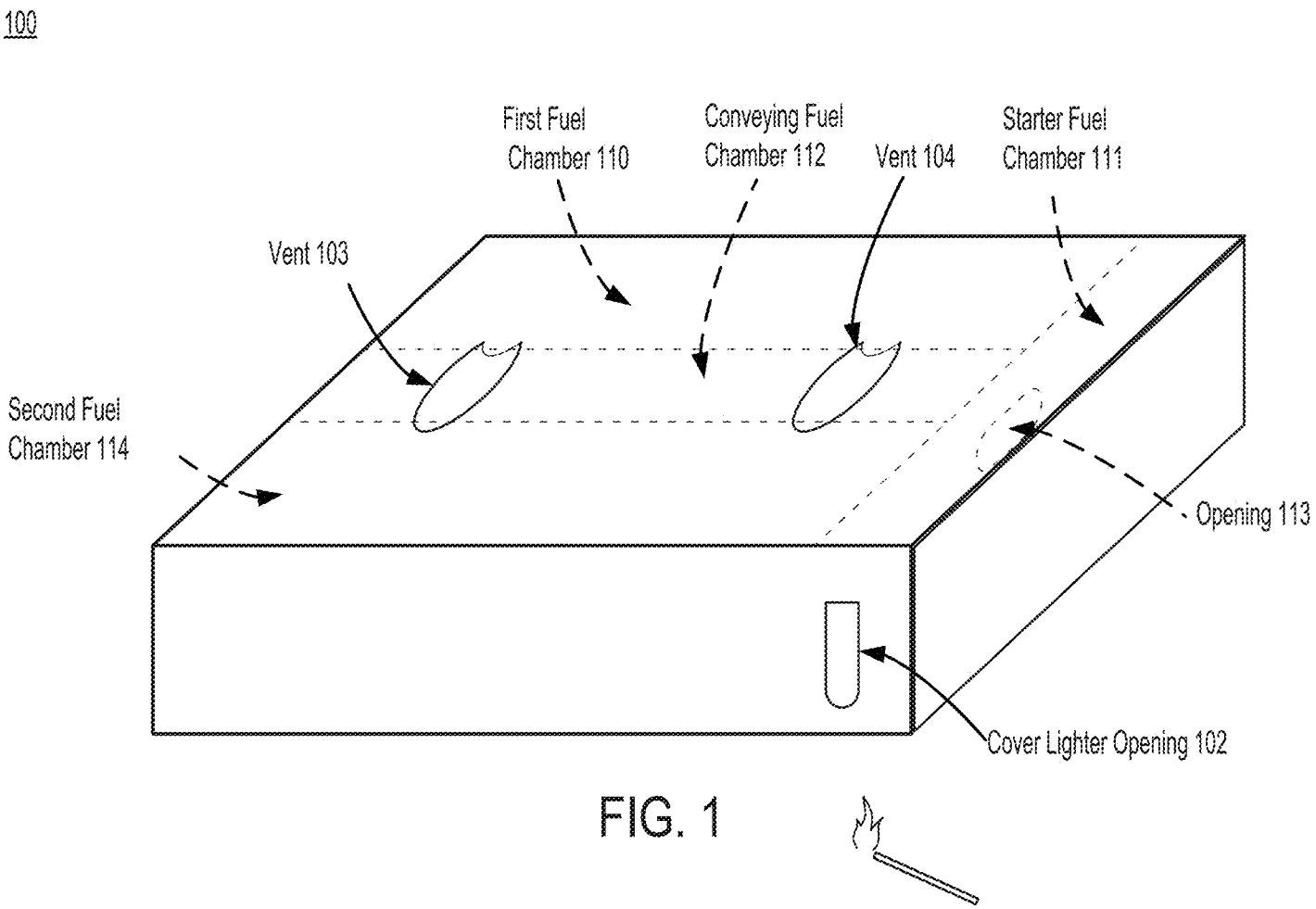
FIG. 1 depicts a front perspective view of a combustible structure, according to certain embodiments of the present invention.

Turning now to the Figures, FIG. 1 depicts a front perspective view of a combustible structure, according to certain embodiments of the present invention. FIG. 1 depicts combustible structure 100. Combustible structure 100 can include one or more of cover lighter opening 102, vent 103, vent 104, first fuel chamber 110, starter fuel chamber 111, conveying fuel chamber 112, opening 113, or second fuel chamber 114.

Objects and structures described or depicted herein such as combustible structure 100 can be formed of materials including but not limited to waxed cardboard, waxed paper, wood chips, or synthetic material. Combustible structure 100 is depicted as a rectangular box, but need not be. For example, combustible structure 100 can be a cube, cylinder, or other shape.

Combustible structure 100 encloses one or more fuels, e.g., an artificial fire log, starter fuels, or conveying fuels. A starter fuel a fuel that is easily ignitable and serves to ignite additional fuel such as a conveying fuel or a fire log. A conveying fuel is a fuel that is easily ignited by the starter fuel and increases combustion such that the internal fuel such as a fire log can be reliably ignited. Examples of starter fuel include paper, "converted paper," "polyethylene" wrappers, wax, cardboard, sawdust, wood, nuts, fiber, or some combination thereof.

Starter fuel and conveying fuel can be chosen based on different characteristics such as ignition time or burn rate. In some cases, the conveying fuel includes larger size particles than the starter fuel. For example, if a starter fuel includes particles of a first size or geometry, then a suitable conveying fuel might include particles of a second, larger, size or geometry that are sufficient to ignite a fire log. Neither fuel is restricted in geometric shape like balls, squares, disc, wedges, chunks, blocks, etc. However, in at least some circumstances, starter fuel and conveying fuel conceivably may be the same.

Combustible structure 100 includes cover lighter opening 102 that can receive ignition from an ignition source such as a match or lighter. Cover lighter opening 102 opens into starter fuel chamber 111. As such, a starter fuel ignites when cover lighter opening 102 receives an ignition source. Cover lighter opening 102 can be prefabricated. For example, a weakened (e.g. perforated) area of combustible structure 100 is capable of being reconfigured as a hole by applying pressure to the area. For example, when pushed, cover lighter opening 102 opens to allow an ignition source to be inserted. Cover lighter opening 102 is depicted on the front of combustible structure 100 for illustrative purposes, but can be located elsewhere on combustible structure 100 as desired. Cover lighter opening 102 is depicted as an oval shape, but can be any shape such as a circle. In an embodiment, the combustible structure 100 can include additional lighter openings at different locations such as the side or top of combustible structure 100. In this manner, lighting combustible structure 100 could be convenient to light when positioned differently.

Combustible structure 100 includes at least one of vent 103 or vent 104. Vents 103-104 provide openings through which gases from combustion of fuels or fire logs retained within combustible structure 100 can escape. Vents 103-104 can be prefabricated, i.e. perforated, holes in combustible structure 100. Vents 103-104 are depicted on the top of combustible structure 100, but either vent could be in another location such as a side of combustible structure 100. Vents 103-104 are depicted as oval-shape but can be any shape such as a circle. In an embodiment, vents 103-104 can also receive an ignition source.

As discussed, each vent 103 and 104 can perform different functions and can do so at different times in a combustion process. For example, vent 103 may serve as a source of air while vent 104 may expel combustion gases, or vice versa. Additionally, cover lighter opening 102 can perform the functions of a vent. In an example, cover lighter opening 102 can initially serve to draw in air, creating a draft through opening 113 to either vent 103, 104 or both. In this manner, the combustion is drawn across the starter fuel chamber 111 into the conveying fuel chamber 112 to ignite one or more fuels.

Figure 2:
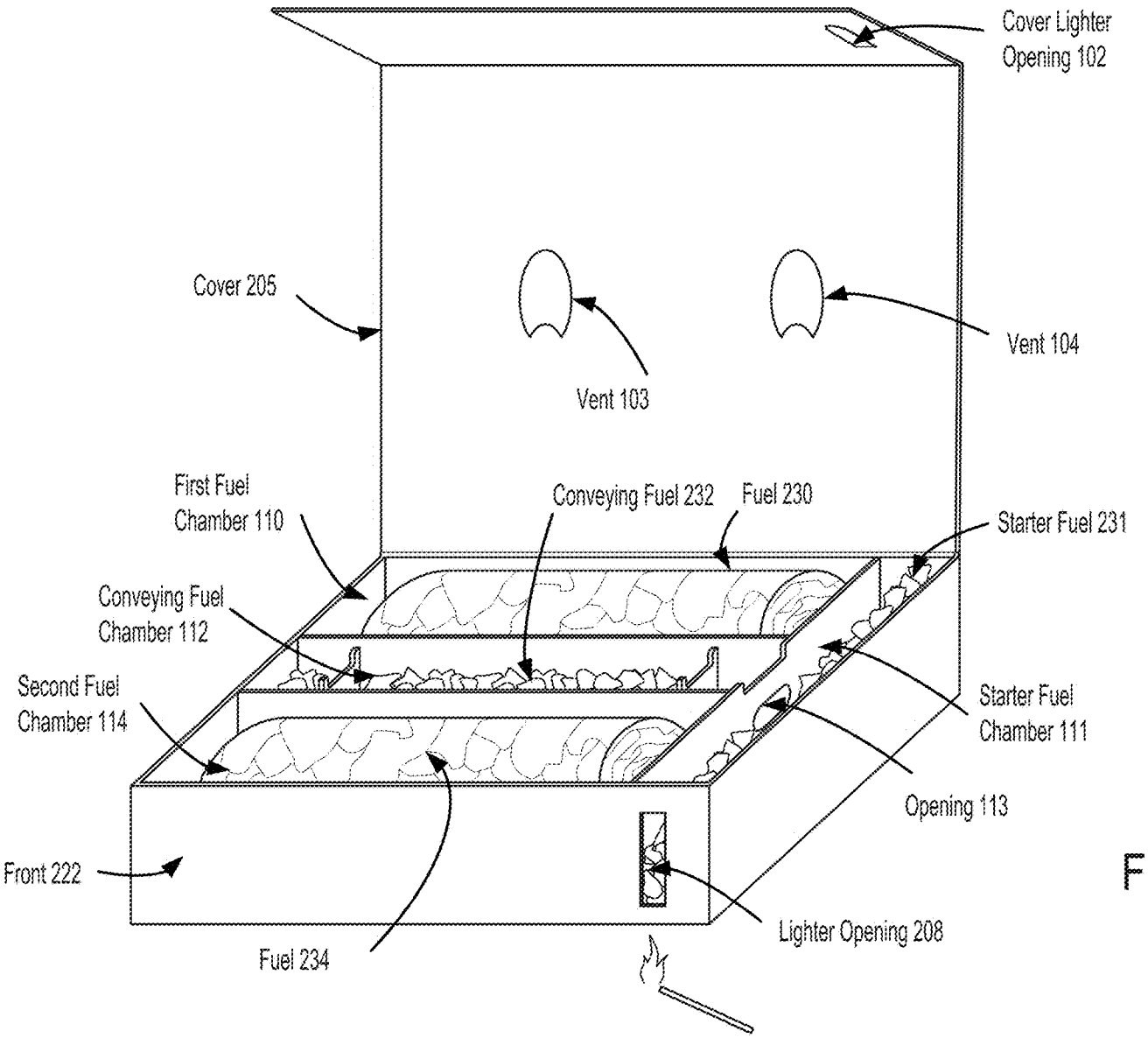
FIG. 2 depicts an internal view of the combustible structure of FIG. 1, according to certain embodiments of the present invention.
Figure 3:
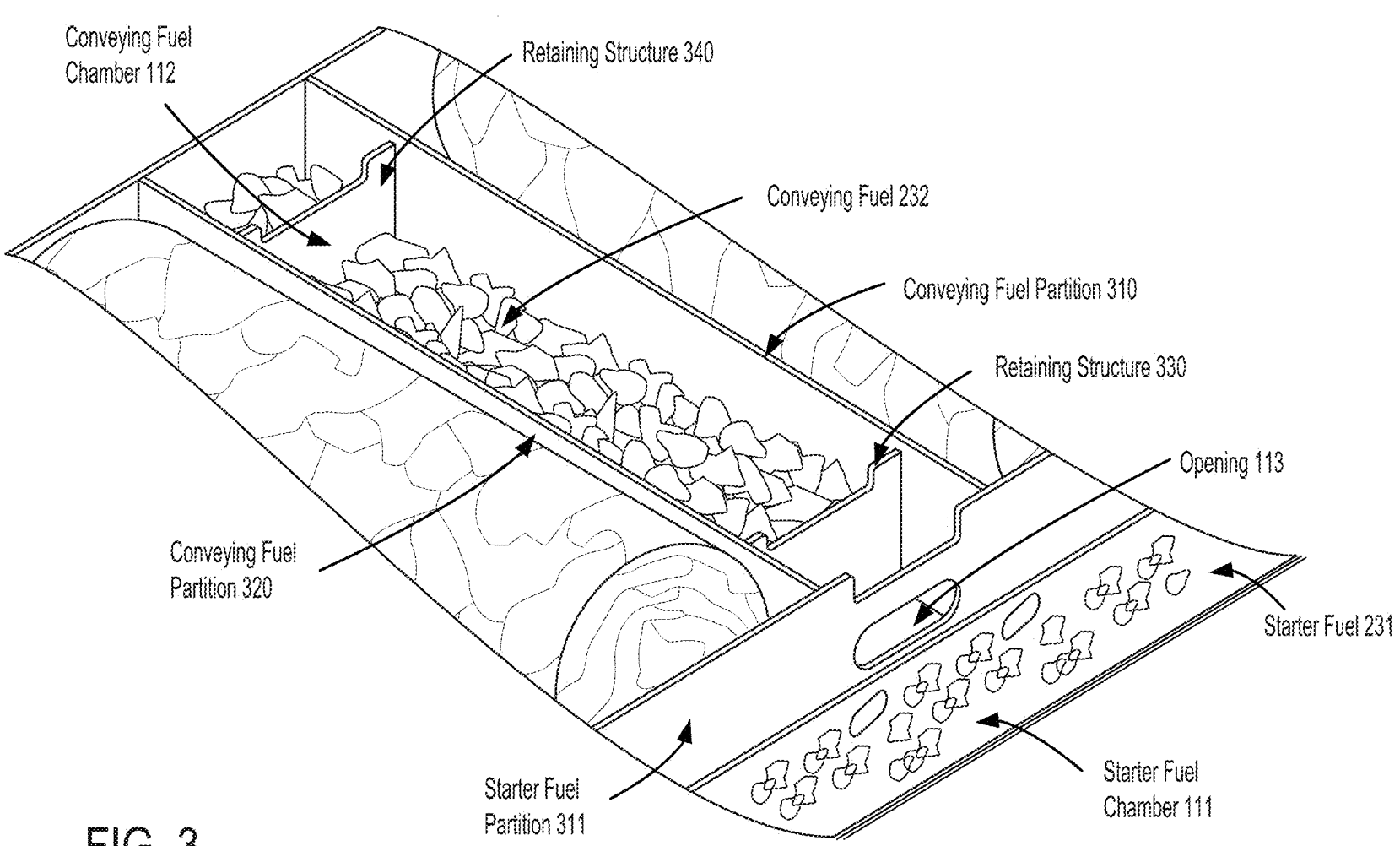
FIG. 3 depicts an expanded view of a starter fuel partition and a retaining structure of the combustible structure of FIGS. 1-2 (with cover removed for clarity), according to certain embodiments of the present invention.

As explained further with respect to FIGS. 2 and 3, combustible structure 100 includes one or more internal fuel chambers. For example, first fuel chamber 110 and second fuel chamber 114 can each receive or hold in place a fuel such as fire log or other suitable fuel. Starter fuel chamber 111 can receive or hold in place starter fuel. Conveying fuel chamber 112 can receive or hold in place conveying fuel. Vent 103 opens into one or more of the first fuel chamber 110, second fuel chamber 114, starter fuel chamber 111, or conveying fuel chamber 112, thereby allowing combustion gases to escape or air to be pulled in by the combustion.

In an example, combustible structure 100 includes a fire log and starter fuel 231. In another example, combustible structure 100 includes a fire log, conveying fuel 232, and starter fuel 231. Combustible structure 100 can include more than one fire log or fuel type.

FIG. 2 depicts an internal view of the combustible structure of FIG. 1, according to certain embodiments of the present invention. FIG. 2 depicts combustible structure 100. Combustible structure 100 can further include lighter opening 208, front 222, conveying fuel 232, fuel 230, fuel 234, or starter fuel 231.

As discussed, combustible structure 100 can include one or more fuels such as a fuel 230 situated in starter fuel chamber 111, a fire log 240 situated in second fuel chamber 114, starter fuel 231 situated in starter fuel chamber 111, or conveying fuel 232 situated in conveying fuel chamber 112.

Chambers 110-112 are located adjacent to each another, connected to each other, or in close proximity with each other, in such a manner as to convey combustion of a fuel that is easier to light to a fuel that is harder to light. As depicted, starter fuel chamber 111 is adjacent to, connected to, or in close proximity with conveying fuel chamber 112. Conveying fuel chamber 112 is between first fuel chamber 110 and second fuel chamber 114. Chambers 110-112 are created or partitioned by one or more retaining structures, discussed further with respect to FIG. 3.

In an exemplary use, cover lighter opening 102 receives ignition from an ignition source. The ignition source ignites starter fuel 231. Starter fuel 231 combusts. The combustion spreads through opening 113 and ignites conveying fuel 232, which in turn ignites fuel 230 and fuel 234. Opening 113, located in a partition, allows air, flames, and combustion gases to flow between the starter fuel chamber and the conveying fuel chamber. As the fire in the structure grows, starter fuel chamber 111 may begin to burn at opening 113 as enable via the drafting of the combustion gases through vents 103-104.

Combustible structure 100 includes cover 205. As depicted in FIG. 2, cover 205 is open. When cover 205 is closed, cover 205 ensures that the fuels inside combustible structure 100 are enclosed within the combustible structure 100. Additionally, when closed, cover 205 may be attached to front 222 such that lighter opening 208 aligns over cover lighter opening 102. In this manner, each chamber 110, 111, 112, and 114 can hold its respective fuel in place such that if the combustible structure 100 is rotated or turned upside down (for example, during shipping), the fuels return to their respective intended positions.

FIG. 3 depicts an expanded view of a starter fuel partition and a retaining structure of the combustible structure of FIGS. 1-2 (with cover removed for clarity), according to certain embodiments of the present invention. FIG. 3 depicts combustible structure 100. Combustible structure 100 can further include conveying fuel partitions 310 and 320, retaining structure 330, retaining structure 340, and starter fuel partition 311. In an aspect, conveying fuel partition 310 and 320 are slightly shorter than the distance between starter fuel partition 311 and the opposite edge of the structure. This allows the heat of the fire and flames to expand into the fuel chambers to ignite the fuel present.

As depicted, combustible structure 100 includes two conveying fuel partitions 310 and 320 that together create conveying fuel chamber 112. Conveying fuel partitions 310 and 320 are separated with retaining structures 330 and 340, which are perpendicular to the conveying fuel partitions 310 and 320 and separated by a length less than or equal to the length of conveying fuel partitions 310 and 320. In this manner, the combination of conveying fuel partitions 310 and 320 and retaining structures 330 and 340 separate fuel 230 and fuel 234, and create conveying fuel chamber 112. In an aspect, conveying retaining structures 330-340 each include a notch that permits improved conveyance of combusting fuel and drafting of the conveying fuel during the ignition process.

Conveying fuel 232 is placed between and around retaining structures 330 and 340. Optionally, a gap exists between retaining structure 330 and starter fuel partition 311. This gap can contain combustible material such as chips (not depicted).

Starter fuel chamber 111 is created by starter fuel partition 311 in conjunction with a side of combustible structure 100. As depicted, starter fuel partition 311 is perpendicular and adjacent to conveying fuel partition 310 and conveying fuel partition 320, but other arrangements are possible. Starter fuel partition 311 is parallel to retaining structure 330 and retaining structure 340. Starter fuel partition 311 holds starter fuel 231 in place. Starter fuel partition 311 includes opening 113 through which combustion, air, or gases can flow.

Figure 4:
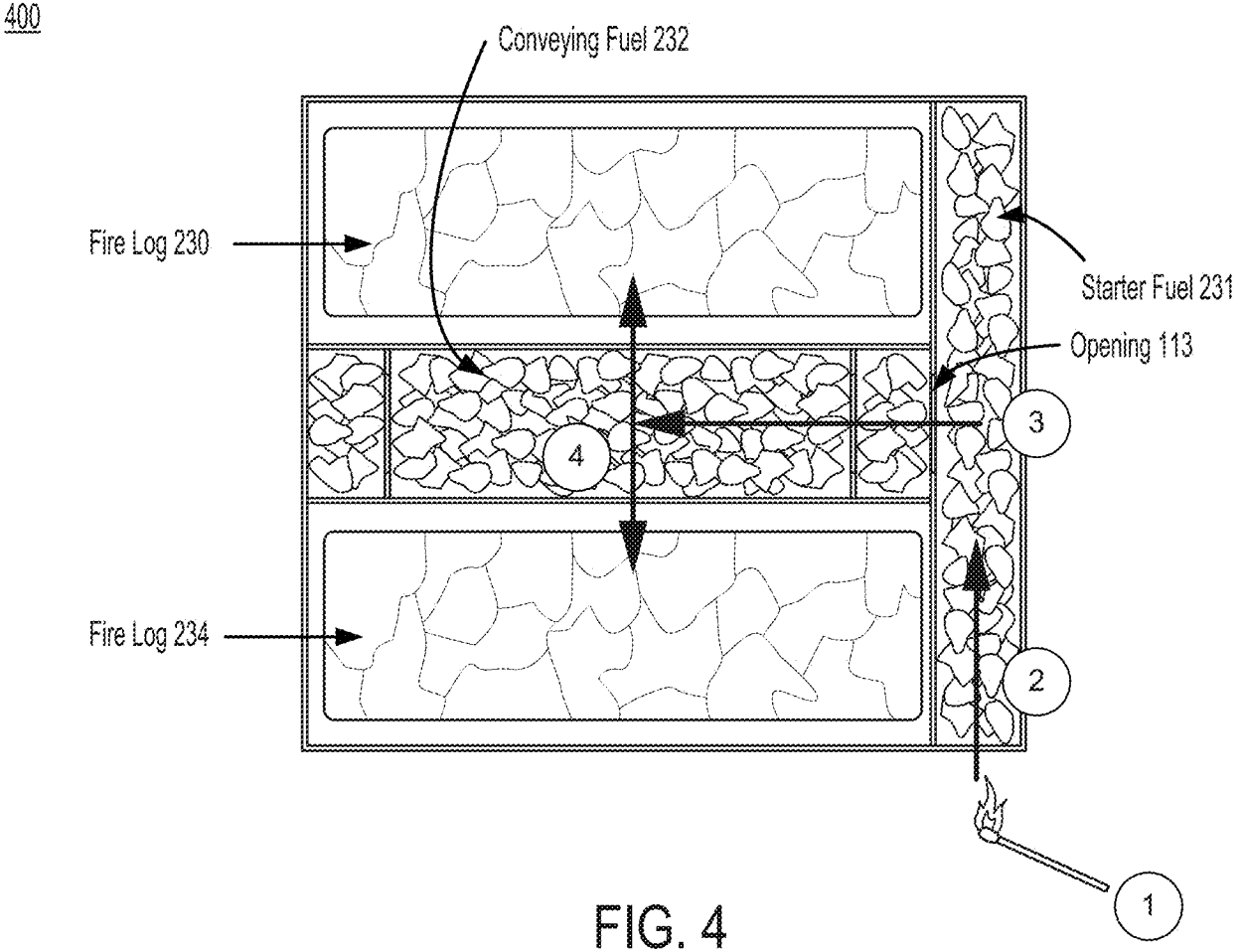
FIG. 4 depicts a top view of the combustible structure of FIGS. 1-3 and an exemplary combustion process, according to certain embodiments of the present invention.

FIG. 4 depicts a top view of the combustible structure of FIGS. 1-3 and an exemplary combustion process, according to certain embodiments of the present invention. Top view 400 includes starter fuel 231, conveying fuel 232, fuel 230 and fuel 234. Additionally, FIG. 4 illustrates exemplary steps of ignition using the combustible structures of FIGS. 1-3. FIG. 4 includes four steps: 1, 2, 3, and 4.

At step 1, cover lighter opening 102 (not depicted) receives an ignition source such as a match or a lighter.

At step 2, the ignition source ignites starter fuel 231. Starter fuel burns in the direction shown at step 2. Air is received via one or more of lighter opening 208, vent 103, or vent 104.

At step 3, combustion from the starter fuel 231 passes through opening 113 to the conveying fuel 232. Alternatively, the combustion burns the material surrounding the opening, e.g., the starter fuel partition 311. The conveying fuel burns in the direction denoted by the arrow 3 towards 4.

At step 4, combustion from the conveying fuel 232 ignites fuel 230 and fuel 234. Combustion gases are expelled from the combustible structure via one or more of lighter opening 208, vent 103, or vent 104. Conveying fuel 232 and starter fuel 231 continue to burn. The internal structures, e.g., partitions, and the external structures of the combustible structure also ignite from the combustion of one or more of the fuels and in turn combust along with the fire logs.

Indeed, in many cases, the entirety of combustion structure 100 may combust, producing significant fire for an extended period and leaving as waste product only (or predominantly), ash.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A combustible structure comprising:

an external wall comprising a first side, a second side, and a third side;

a first fuel chamber adjacent to the first side, the first fuel chamber comprising a first artificial fire log, wherein the first artificial fire log comprises synthetic material;

a second fuel chamber adjacent to the second side, the second fuel chamber comprising a second artificial fire log, wherein the second artificial fire log comprises synthetic material;

a conveying fuel chamber formed by (i) a first interior wall located between the first fuel chamber and the conveying fuel chamber and (ii) a second interior wall located between the second fuel chamber and the conveying fuel chamber, the conveying fuel chamber comprising a conveying fuel, wherein the conveying fuel chamber comprises a retaining wall between and substantially perpendicular to the first interior wall and second interior wall;

a starter fuel chamber formed between the third side and a third interior wall, wherein the third interior wall is substantially perpendicular to the first interior wall and the second interior wall, the starter fuel chamber comprising a starter fuel, wherein the first fuel chamber, the second fuel chamber, the conveying fuel chamber, and the starter fuel chamber are arranged in a substantially horizontal plane, wherein the third interior wall defines an opening between the starter fuel chamber and the conveying fuel chamber, and wherein the first side or the second side defines an external lighter opening into the starter fuel chamber; and a cover configurable to hold the starter fuel in the starter fuel chamber and the conveying fuel in the conveying fuel chamber, the cover defining an external vent, wherein when the cover is closed, the external vent is aligned with the conveying fuel chamber, and wherein the starter fuel comprises particles of a first geometry and the conveying fuel comprises particles of a second geometry that is larger than the first geometry.

2. The combustible structure of claim 1, wherein the first interior wall and the second interior wall hold the first artificial fire log and the second artificial fire log in place such that combustion in the conveying fuel chamber spreads to the first fuel chamber or the second fuel chamber.

3. The combustible structure of claim 1, wherein the first artificial fire log and the second artificial fire log are mostly cylindrical, triangle (wedge), or square shape and comprise a material sufficiently solid to maintain its shape at normal room temperatures, the material comprising one or more of (i) wax paper and (ii) cardboard.

4. The combustible structure of claim 1, wherein the starter fuel comprises a first synthetic material and the conveying fuel comprises a second synthetic material different from the first synthetic material.

5. The combustible structure of claim 1, wherein the starter fuel and the conveying fuel comprise synthetic material.

6. The combustible structure of claim 1, wherein the external vent the opening, and the external lighter opening create a drafting effect during combustion of the combustible structure or parts thereof.

7. The combustible structure of claim 1, wherein the conveying fuel comprises synthetic material.

8. The combustible structure of claim 1, wherein the first fuel chamber and the second fuel chamber are oriented adjacent to and perpendicular to the starter fuel chamber.

9. The combustible structure of claim 1, wherein the second side is substantially parallel to the first side.

10. The combustible structure of claim 1, wherein the third side is substantially perpendicular to the first side and the second side.

11. A combustible structure comprising:

a starter fuel chamber formed from a first interior wall comprising a starter fuel, an external lighter opening, and an internal opening;

a conveying fuel chamber (i) formed by a second interior wall and (ii) adjacent to the starter fuel chamber, wherein the conveying fuel chamber is connected to the starter fuel chamber by the internal opening, and wherein the conveying fuel chamber comprises a retaining wall between and substantially perpendicular to the first interior wall and second interior wall;

a fuel chamber adjacent to the conveying fuel chamber, the fuel chamber comprising:

a first artificial fire log that comprises synthetic material; and a second internal wall that separates the first artificial fire log and the conveying fuel chamber; and a cover that when closed, covers the starter fuel chamber, conveying fuel chamber, and fuel chamber and comprises an external vent that, when the cover is closed, opens into the conveying fuel chamber, wherein the starter fuel chamber, the conveying fuel chamber, and the fuel chamber are arranged in a substantially horizontal plane.

12. The combustible structure of claim 11, wherein the first artificial fire log is mostly (i) square, (ii) triangular, or (iii) cylindrical shape and comprises a material sufficiently solid to maintain shape at normal room temperatures.

13. The combustible structure of claim 11, wherein the combustible structure is portable and can be transported while maintaining the first artificial fire log within the fuel chamber and the starter fuel within the starter fuel chamber.

14. The combustible structure of claim 11, wherein one or more of the external vent, the internal opening, and the external lighter opening create a drafting effect during combustion of the combustible structure.

15. The combustible structure of claim 11, wherein the starter fuel comprises particles of a first geometry and the conveying fuel chamber comprises a conveying fuel that comprises particles of a second geometry that is larger than the first geometry.

16. A combustible structure comprising:

(i) an exterior surface comprising a vent configured to receive an ignition source and positioned adjacent to a starter fuel; and (ii) an interior region comprising:

a first interior wall forming a starter fuel chamber comprising the starter fuel;

a second interior wall substantially perpendicular to and intersecting with the first interior wall, the second interior wall forming a fuel chamber comprising an artificial fire log positioned such that combustion of the starter fuel spreads to the artificial fire log, wherein the artificial fire log comprises synthetic material, wherein the fuel chamber is oriented adjacent to and perpendicular to the starter fuel chamber, wherein the fuel chamber and the starter fuel chamber are arranged in a substantially horizontal plane, and wherein the first interior wall comprises an internal opening that facilitates combustion in the starter fuel chamber spreading to the fuel chamber through the internal opening; and a retaining wall substantially perpendicular to the second interior wall, wherein the retaining wall holds the artificial fire log in place.

17. The combustible structure of claim 16, wherein the artificial fire log is a cylindrical shape and comprises a material sufficiently solid to maintain its shape at normal room temperatures.

18. The combustible structure of claim 16, wherein the starter fuel comprises a first material and the artificial fire log comprises a second material different from the first material.

19. The combustible structure of claim 18, further comprising a cover and an external vent that is disposed in the cover, wherein when the cover is closed, the external vent is aligned with the fuel chamber.

* * * * *